US008555754B2

(12) United States Patent
Chen et al.

(10) Patent No.: US 8,555,754 B2
(45) Date of Patent: Oct. 15, 2013

(54) BIASED PLIERS

(75) Inventors: Chungeng Chen, Las Vegas, NV (US); John A. Hermann, Las Vegas, NV (US)

(73) Assignee: JS Products, Inc., Las Vegas, NV (US)

( * ) Notice: Subject to any disclaimer, the term of this patent is extended or adjusted under 35 U.S.C. 154(b) by 215 days.

(21) Appl. No.: 12/961,286

(22) Filed: Dec. 6, 2010

(65) Prior Publication Data

US 2012/0137840 A1 Jun. 7, 2012

(51) Int. Cl.
*B25B 7/08* (2006.01)

(52) U.S. Cl.
USPC ..... 81/416; 81/417

(58) Field of Classification Search
USPC ..... 81/416, 417, 427
See application file for complete search history.

(56) References Cited

U.S. PATENT DOCUMENTS

| | | | | |
|---|---|---|---|---|
| 1,657,348 | A | 1/1928 | Drumm | |
| 2,392,118 | A | 1/1946 | Cacarillo | |
| 4,478,532 | A * | 10/1984 | Puro | 403/157 |
| 4,621,401 | A | 11/1986 | Anderson | |
| 4,635,510 | A | 1/1987 | Box | |
| 4,669,340 | A | 6/1987 | Igarashi | |
| 4,903,558 | A | 2/1990 | Le Duc | |
| 5,863,033 | A | 1/1999 | Bradford | |
| 5,904,078 | A | 5/1999 | Gustafson et al. | |
| 6,098,508 | A | 8/2000 | Battistone | |
| 6,176,158 | B1 * | 1/2001 | Chen | 81/417 |
| 6,647,835 | B1 * | 11/2003 | Tseng | 81/423 |
| 7,258,047 | B1 * | 8/2007 | Wolter et al. | 81/416 |
| 7,389,715 | B1 * | 6/2008 | Lin | 81/416 |
| 7,578,218 | B2 | 8/2009 | Hood et al. | |
| 7,640,667 | B2 * | 1/2010 | Pollock et al. | 30/267 |
| 7,654,177 | B1 | 2/2010 | Cronin | |
| 2005/0011321 | A1 * | 1/2005 | Hsien | 81/417 |
| 2005/0279195 | A1 | 12/2005 | Hile | |
| 2012/0011970 | A1 * | 1/2012 | Chen | 81/427 |

* cited by examiner

*Primary Examiner* — David B Thomas
(74) *Attorney, Agent, or Firm* — Weide & Miller, Ltd.

(57) ABSTRACT

A tool, such as fixed-joint pliers, has first and second levers which are movably joined. The levers are joined at a joint comprising a housing and a coupler. The housing is defined by a first housing portion of the first lever and a second housing portion of the second lever. The housing has an interior area which houses a biasing member, such as a torsion spring. The coupler may comprise first and second bushings which extend through a passage through the housing and the torsion spring therein, and a male fastener which extends through one of the bushings and into engagement with the other bushing. The pliers have a thin profile and are biased to an open position for use.

10 Claims, 6 Drawing Sheets

BIASED PLIERS

FIELD OF THE INVENTION

The present invention relates to pliers and, more particularly, pliers which are biased into a particular position.

BACKGROUND OF THE INVENTION

A wide variety of configurations of pliers are well known. Generally, pliers have two plier halves which are pivotally connected to one another. Each plier half has a handle portion and a jaw portion. A user may grip the handle portions of the two halves and manually move the handle portions so as to open or close the jaw portion of the pliers.

One problem with these types of pliers is that in some instances it is difficult for the user to move the plier halves. For example, in a tight space a user may only be able to grip the pliers with one hand, making movement of the pliers, especially spreading of the handle portions apart so as to open the jaw portion of the pliers, very difficult.

Some attempts have been made at addressing this problem, but these attempts have resulted in pliers which are in some cases oversized or undesirable in configuration, which are complex in configuration and thus expensive to manufacture, or which have various drawbacks of operation.

SUMMARY OF THE INVENTION

One aspect of the invention comprises a tool comprising first and second tool levers. In a preferred embodiment, the tool comprises fixed-joint pliers which are biased to a particular position, such as an open position.

In one embodiment, the tool comprises a first tool lever having a first gripping end and a second jaw end and a second tool lever having a first gripping end and a second jaw end, the first and second tool levers pivotally connected whereby the tool has a first tool jaw end comprising the second jaw ends of said first and second tool levers and a generally opposing user-gripping end comprising the first gripping ends of said first and second tool levers.

The first and second tool levers collectively define a housing between the first and second ends of the tool, the housing comprising a first housing portion defined by the first tool lever and a second housing portion defined by the second tool lever, the housing defining an interior area and having a passage there through.

In a preferred embodiment, the tool further comprises a biasing member. The biasing member preferably comprises a torsion spring having a body having a first end and a second end, the first end engaging the first housing portion and the second end engaging the second housing portion.

In one embodiment, a coupler joins the first and second tool levers, the coupler having a first end located at an exterior of the first tool lever and a second end located at an exterior of the second tool lever and extending through the passage through the housing.

Preferably, in such a configuration, the first and second tool levers are biased to an open jaw position by the biasing member and may be pivoted about the coupler to a closed jaw position.

In a preferred embodiment, the ends of the torsion spring are located in generally the same plane as the body and extend in generally opposing directions from one another. The ends may engage corresponding notches in the first and second housing portions which comprise the housing.

In a preferred embodiment, the coupler comprises a pair of bushings which are located at opposing sides of the tool and extend into the first and second housing portions. One of the bushings may comprise a female fastener member. A male fastener may extend through the other bushing into engagement with the female fastener.

Also, in accordance with the preferred embodiment, the first and second housing portions define generally circular or cylindrical seats below rim portions thereof. The biasing member is positioned inside of the housing between the seats. The coupler extends through the passage through the housing, including the seats, and preferably through the biasing member which is positioned on the seats.

In accordance with the invention, a tool is defined which is biased to a particular position, such as one where the jaws are in an open position. A user may grip the levers at their gripping ends and move the jaws to a second or closed position.

The tool has a thin profile due to the arrangement of the biasing member within the housing. In addition, the exterior of the tool at each side is generally planar. Also, the coupling of the levers about the bushings causes the levers to pivot or rotate without binding.

Further objects, features, and advantages of the present invention over the prior art will become apparent from the detailed description of the drawings which follows, when considered with the attached figures.

DETAILED DESCRIPTION OF THE INVENTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

One embodiment of the invention comprises a tool comprising a pair of levers which are movable relative to one another. In a preferred embodiment, the tool comprises pliers having a pair of levers or halves which are moveable between a first or open position and a second or closed position, and which include at least one biasing member or mechanism configured to bias the pliers into at least one of the first or second positions. In a preferred embodiment, the biasing member comprises a spring which is encapsulated or contained within the plier levers at a hinge or pivot thereof and which is configured to bias the pliers into an open position.

Figure 1:
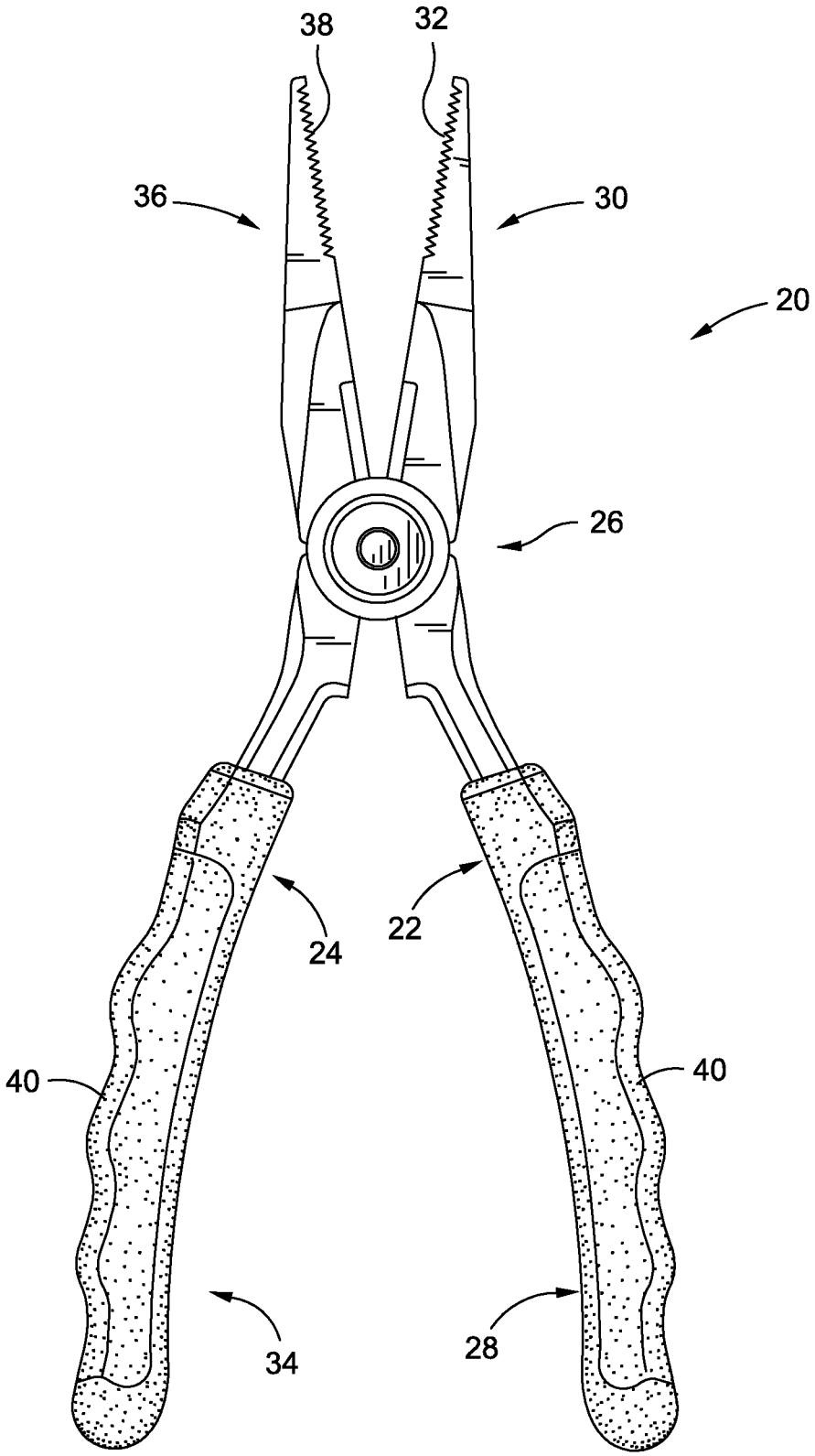
FIG. 1 is a perspective view of one embodiment of pliers in accordance with the present invention.

One embodiment of the invention will be described with reference to FIGS. 1-3. As illustrated in FIG. 1, a tool/pliers 20 of the invention comprise a first plier/tool half or lever 22 and a second plier/tool half or lever 24. The first and second plier levers 22,24 are movably jointed at a joint 26, as described in more detail below.

In one embodiment, the first plier lever 22 has a first end 28 and an opposing second end 30. The first end 28 is preferably configured as a grip. In one embodiment, the first end 28 may thus be configured to be slightly arcuate, bending inwardly towards the second plier lever 24.

The second end 30 of the first plier lever 22 is preferably configured as one half of a tool head or jaw. As illustrated, the pliers 20 may be configured as needle-nose type pliers. In such a configuration, the second end 30 of the first plier lever 22 may have a tapered end. The second end 30 may define a contact or jaw surface 32. The contact surface 32 may be smooth and/or include one or more serrations or other features for use in improving engagement of the tool 20 with other features, including for securing the pliers to such an object or cutting the object.

The second plier lever 24 also preferably has a first end 34 and a generally opposing second end 36. The first end 34 is also preferably configured as a grip and may also be slightly arcuate, bending inwardly towards the first plier lever 22.

The second end 36 of the second plier lever 24 is preferably configured as a second half of a tool head or jaw for mating with the first half defined by the first plier lever 22. In the embodiment where the pliers 20 are configured as needle-nose type pliers, the second end 36 of the second plier lever 24 may also have at tapered end. As with the first plier lever 22, the second end of the second plier lever 24 may define a contact surface 38 which may be smooth and/or include one or more serrations or other features for use in improving engagement of the tool 20 with other features.

In one embodiment, the first and second plier levers 22,24 may be constructed from a durable metal. For example, the first and second plier levers 22,24 may be constructed in a metal forging process.

As indicated below, the first and second plier levers 22,24 are preferably movably connected to one another. So connected, the pliers 20 have a first end for gripping by a user, the first end comprising the first ends of the first and second plier levers 22,24. The pliers 20 have an opposing second or "jaw" end comprising the second ends of the first and second plier levers 22,24.

In order to increase user comfort when gripping the first ends 28,34 of the first and second plier levers 22,24 during use of the tool 20, a coating or grip may be applied to thereto. As illustrated, for example, a plastic, rubber or similar high friction, durable grip 40 may be placed over or applied to the first ends 28,34 of the first and second plier levers 22,24. The grips 40 may be various colors, have finger contours, detents or the like.

Of course, the basic configuration of the pliers 20 may vary. For example, the pliers 20 might be configured to have cutting or crimping jaws, be flat-nosed, round-nosed, etc. Also, the shapes of the first ends 28,34 of the first and second plier halves 22,24 may vary, as may their length, such as depending upon the application.

As indicated above, the first and second plier levers 22,24 are preferably connected or joined at a joint 26. In one embodiment, the joint 26 is located between the first and second ends of each of the first and second plier levers 22,24. The joint 26 may be located closer to the second ends 30,36 of the first and second plier levers 22,24 so that a high lever force is generated at the second ends 30,36 when a user grips the first ends 28,34.

Details of the plier joint 26 will be described with reference to FIG. 2. As illustrated therein, in one embodiment the joint 26 comprises a housing 42, at least one biasing element 44 and at least one coupler 46.

The housing 42 is preferably configured to house the at least one biasing element 44. In one embodiment the housing 42 comprises a first housing section or portion 48 and a mating second housing section or portion 50. The first housing portion 48 is preferably defined by or associated with the first plier half 22. The second housing portion 50 is preferably defined by or associated with the second plier half 24. When coupled, the first and second housing portions 48,50 preferably define an interior area or space 52 of the housing 42.

In a preferred embodiment, the at least one biasing element 44 is located inside of the housing 42. In a preferred embodiment, the biasing element 44 comprises a coiled torsion spring. The spring 44 comprises a body having a first end 54 and a second end 56 and an intermediate section or body 58. In one embodiment, the intermediate section 58 is coiled. The first and second ends 54,56 extend outwardly from the intermediate section 58 generally transverse or perpendicular thereto. In a preferred embodiment, the first end 54 and second end 56 extend outwardly generally 180 degrees from one another about the intermediate section 58, in generally opposing directions. Due to the coiled configuration of the torsion spring 44, the first end 54 is located at the top of the spring and the second end 56 is located at the bottom of the spring (i.e. the first and second ends 54,56 are not located at exactly the same elevation, though they are generally located in the same plane as the body 58 of the spring 44).

In a preferred embodiment, the first housing portion 48 defines a seat 60 in the interior thereof. The seat 60 is preferably situated downwardly from a top rim 62 of the first housing portion 48. In addition, the first housing portion 48 defines a mount 64 for the second end 56 of the torsion spring 44. This mount 64 may comprise a detent or recess in the wall of the first housing portion 48, the detent extending outwardly from the seat 60.

The second housing portion 50 preferably defines a similar seat 61 (see FIG. 3B) in the interior thereof. The seat is preferably situated downwardly from a top rim 66 of the second housing portion 50. In addition, the second housing portion 50 preferably defines a similar mount 65 (see FIG. 3B) for the first end 54 of the torsion spring 44. This mount may similarly comprise a detent or recess in the wall of the second housing portion 50, the detent extending outwardly from the seat.

As indicated, in a preferred embodiment, the biasing member comprises a coiled torsion spring 44. So that the torsion spring 44 is tightly captured in the housing 42, the interior space defined by the first and second housing portions 48,50 is preferably generally cylindrical. As illustrated, for example, the seat 60 of the first housing portion 48 is generally circular, having an outside diameter approximately the same as the outside diameter of the spring 44 and an inside diameter approximately the same as the inside diameter of the spring 44.

As also indicated above, the pliers 20 further comprise at least one coupler 46. The coupler 46 preferably rotatably connects the first and second plier levers 22,24.

In a preferred embodiment, the coupler 46 connects the first and second plier levers 22,24. In one embodiment, the coupler 46 comprises interconnecting first and second members, such as a first or male connector or fastener 68 and a mating second or female connector or fastener 70. The male fastener 68 may have the form of a threaded screw or bolt. As illustrated, the male fastener 68 may have a head 72 and a shank 74 which is at least partially threaded.

The female fastener 70 may have the form of a threaded bushing. The bushing may have a head 76 and a sleeve 78 which extends outwardly from the head 76. The sleeve 78 may have a reduced diameter relative to the head 76. The bushing preferably defines a passage through at least a portion of the sleeve 78 (and such passage may extend all the way through the bushing), at least a portion of the passage being internally threaded and configured to accept at least a portion of the threaded shank 74 of the male fastener 68.

The coupler 46 extends through the pliers 20 from a first side to a second side thereof. As illustrated, the head 72 of the male fastener 68 may be located at the outside of the first plier lever 22 and extend through the first and second plier levers 22,24 to the head 76 of the female fastener 70 which is located at the outside of the second plier lever 24.

In order to facilitate the passage of the coupler 46 through the pliers 20, a passage is defined through the housing 42. In one embodiment, the first plier lever 22 defines a passage 80 there through, preferably at the first housing portion 48. This passage 80 is preferably centrally located and arranged so that the seat 60 encircles the passage 80 and so that the coupler 46 extends through the torsion spring 44 which is located on the seat 60. Likewise, the second plier lever 22 preferably defines a similar passage 82 there through. Again, this passage 82 preferably extends through the second housing portion 50.

As indicated, the male fastener 68 is configured to selectively engage the female fastener 70 in a manner which creates a locking or joining force which maintains the first and second plier levers 22,24 in close proximity. Because the first and second plier levers 22,24 are joined about a cylindrical coupler, however, they are permitted to freely rotate relative to one another, such as between open and closed positions.

In order to facilitate smooth rotation of the first and second plier levers 22,24 relative to the coupler 46, the coupler preferably includes a secondary bushing 84. The secondary bushing 84 may have a head 86 and a sleeve 88 and preferably defines a passage there through. The head 86 is configured to engage the outside of the plier lever at which the head 72 of the male fastener 68 is located, such as at the first plier lever 22. The head 86 of the secondary bushing 84 is configured to be positioned between that plier lever and the head 72 of the male fastener 68. The sleeve 88 of the secondary bushing 84 then extends into the passage 80 defined by the first housing portion 48. In this manner, the first and second plier levers 22,24 are mounted for rotation around the bushing which comprises the female fastener 70 and the secondary bushing 84. This configuration promotion free and smooth rotation of the first and second plier levers 22,24 because they rotate around or relative to the smooth surfaces of the bushings rather than the threaded shank 74 and small head 72 of the male fastener 68.

Figure 3A:
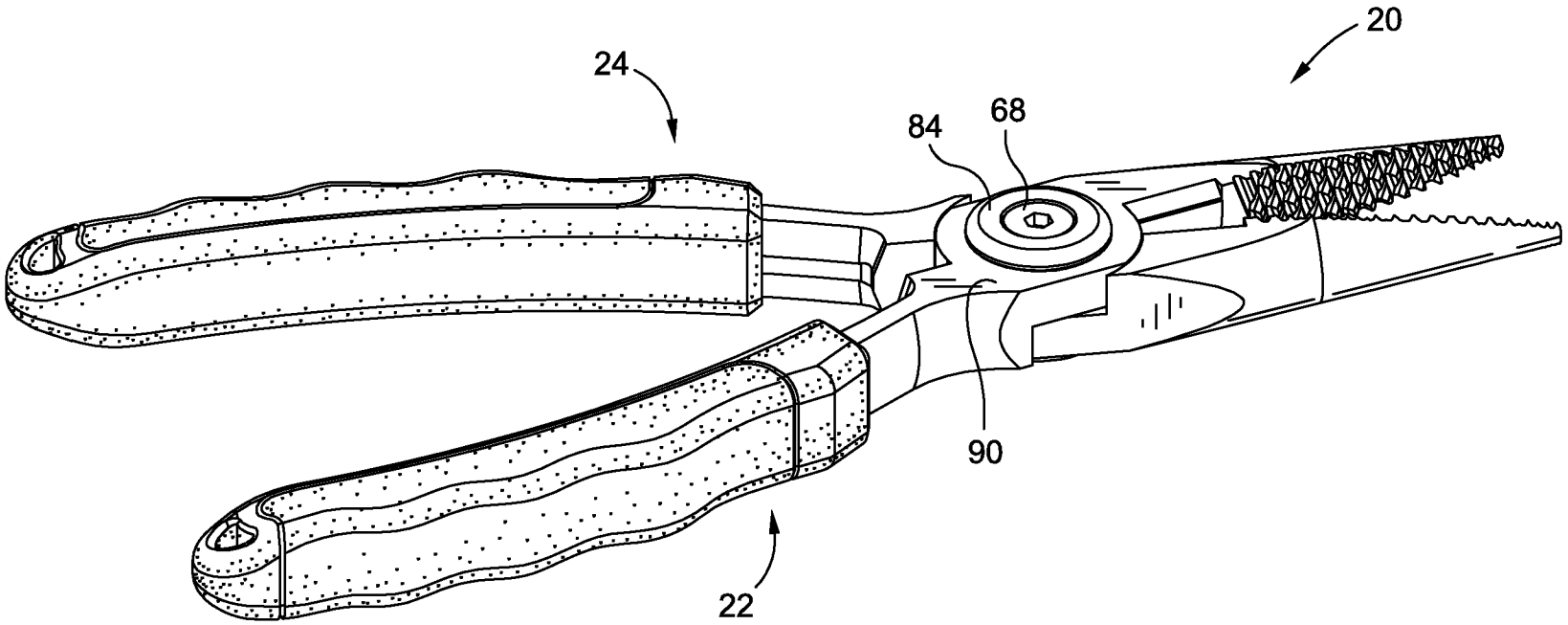
FIG. 3A is a perspective view of an embodiment of pliers having a non-flush coupler.
Figure 3B:
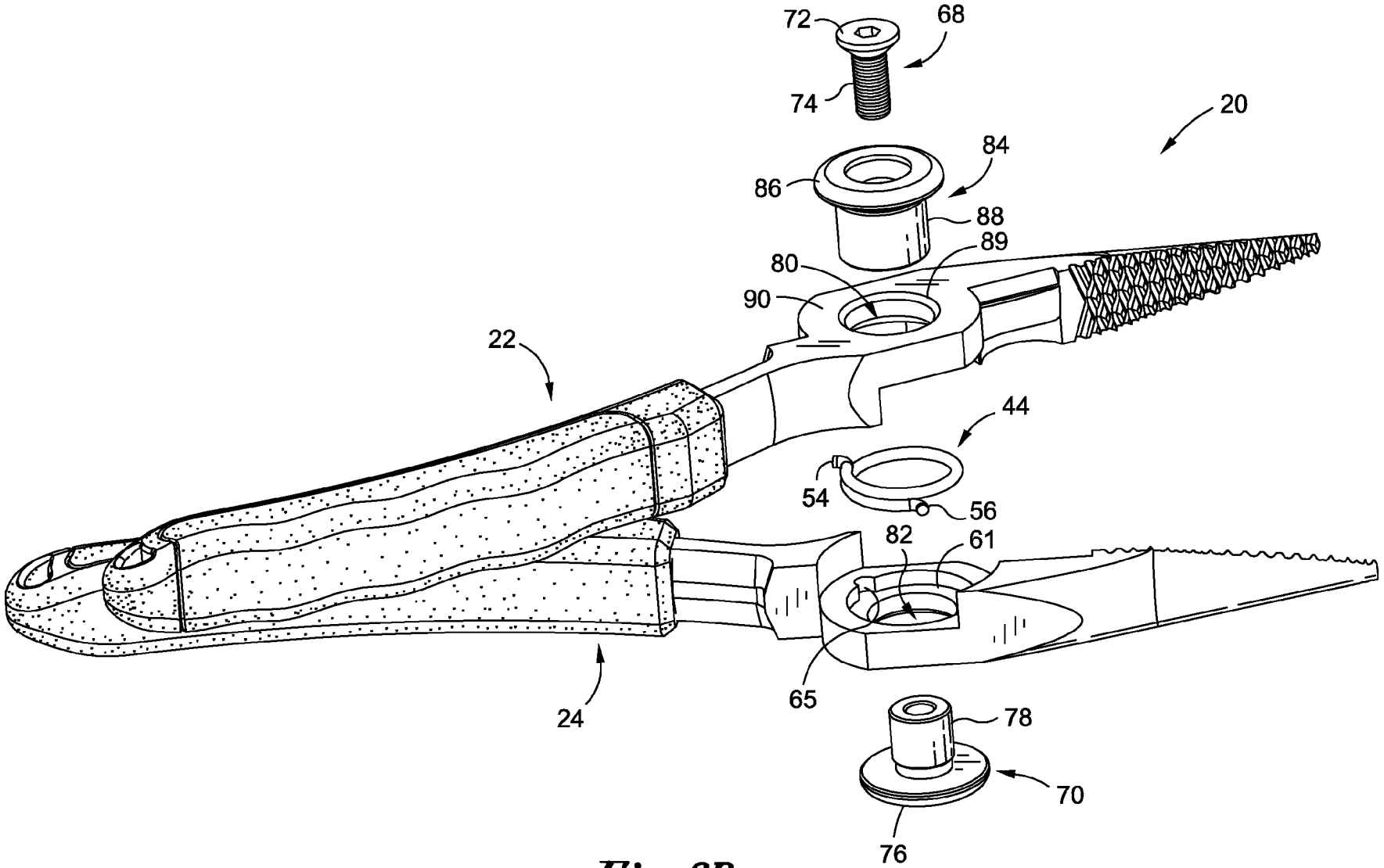
FIG. 3B is an exploded view of the pliers illustrated in FIG. 3A.

In one embodiment, as illustrated in FIGS. 3A and 3B, an outside/exterior face or surface 90 of the first plier lever 22 about at least the passage 82 is generally planar and smooth. The head 86 of the secondary bushing 84 is configured to extend outwardly beyond the circumference of the passage 80 so that a bottom surface of the head 86 rests upon the outside face 90 of the first plier lever 22, or a tapered or beveled edge 89 thereof at the passage 80. In this configuration, the head 86 of the secondary bushing 84 protrudes outwardly from the outside face 90 of the first plier lever 22, such that the connection at the joint thereof is non-flush as best illustrated in FIG. 3B.

Figure 4A:
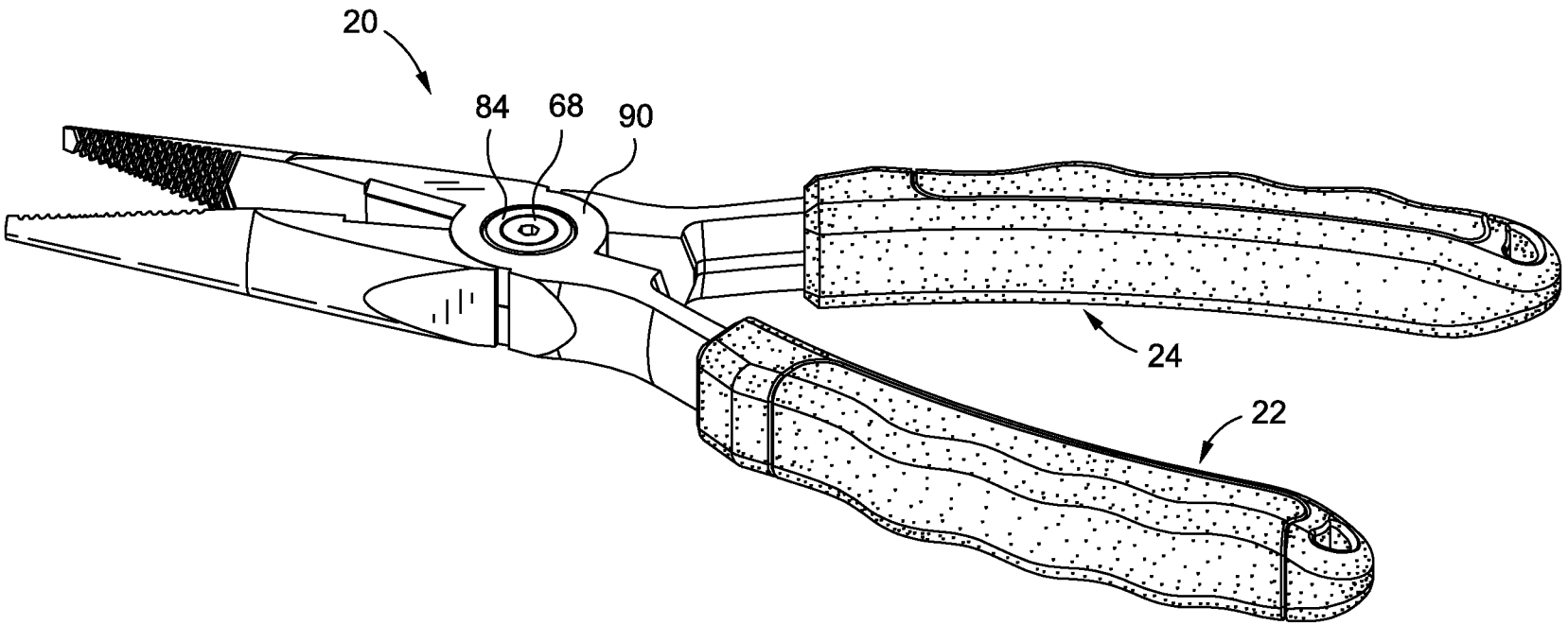
FIG. 4A is a perspective view of an embodiment of pliers having a flush coupler.
Figure 4B:
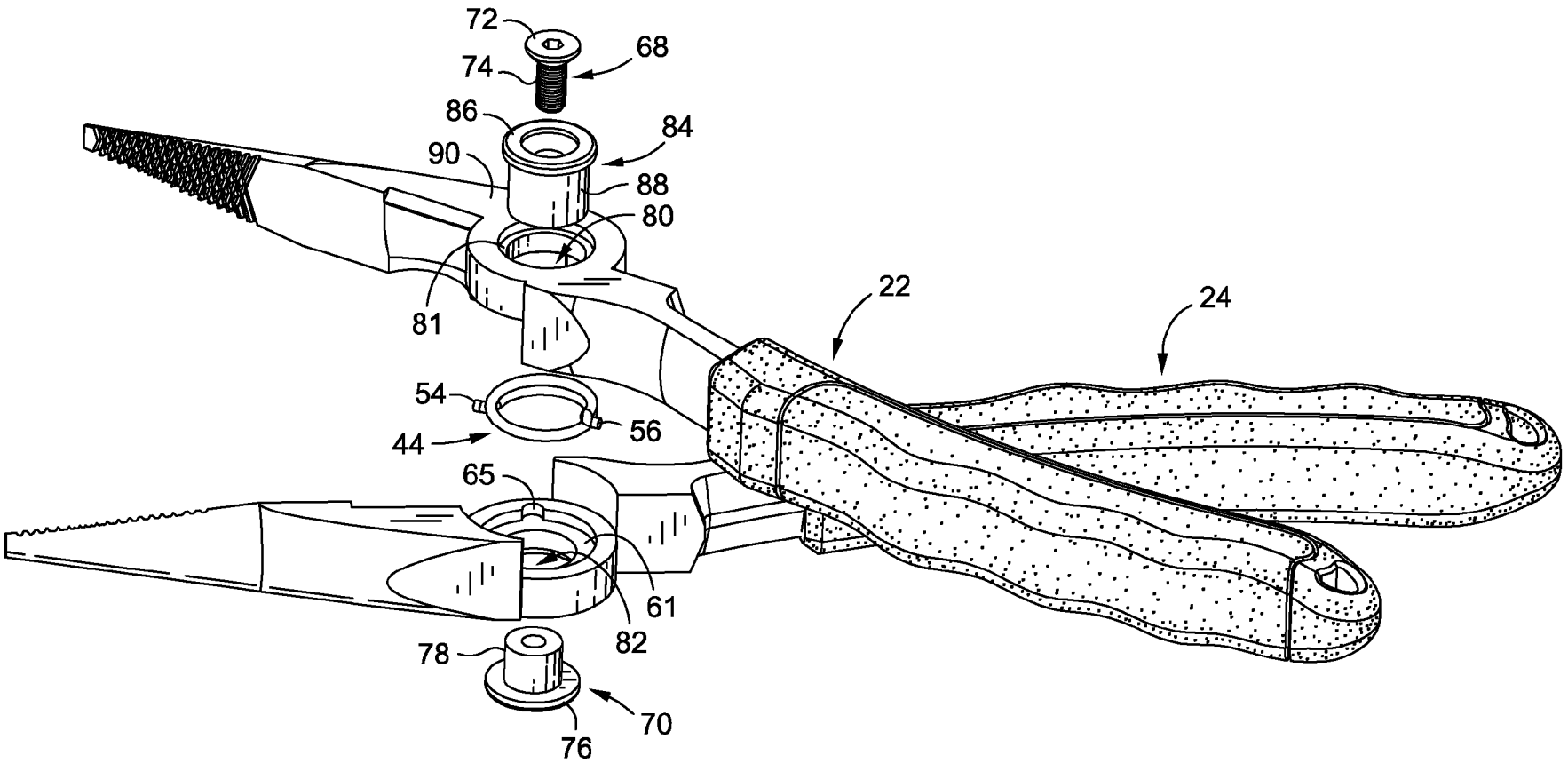
FIG. 4B is an exploded view of the pliers illustrated in FIG. 4A.

In another embodiment, as illustrated in FIGS. 4A and 4B, the passage 80 may include an enlarged section 81 which is configured to accept the head 86 of the secondary bushing 84. As illustrated in FIG. 4A, this allows the head 86 of the secondary bushing 84 to fit within the first plier lever 22 so that an end or top surface of the head 86 is generally flush with or at least does not extend beyond, the outer surface 90 of the first plier lever 22.

In a preferred embodiment, as illustrated in both FIGS. 3A and 4A, the male fastener 68 may be configured to be located in the secondary bushing 84. In particular, the secondary bushing 84 may include a recess for accepting the head 72 of the male fastener 68, whereby the head 72 of the male fastener 72 does not protrude outwardly beyond the secondary bushing 84.

It will be appreciated that the connection of the female fastener 70 may be similarly configured to either be a flush or non-flush mount. For example, the passage 82 through the second plier lever 24 may include a recessed portion for accepting the head 76 of the female fastener 70 so that the top or end thereof is generally flush with an exterior or outer surface 91 of the second plier lever 24. Alternatively, the head 76 of the female fastener 70 could extend outwardly of the outer surface 91, as illustrated in FIG. 2.

Preferably, the sleeve 78 portion of the female fastener 70 is close in size to the passage 82, such as being only slightly smaller in diameter, so that the second plier lever 24 rotates about an axis through the passage 82 (and does not wobble or tilt).

Figure 2:
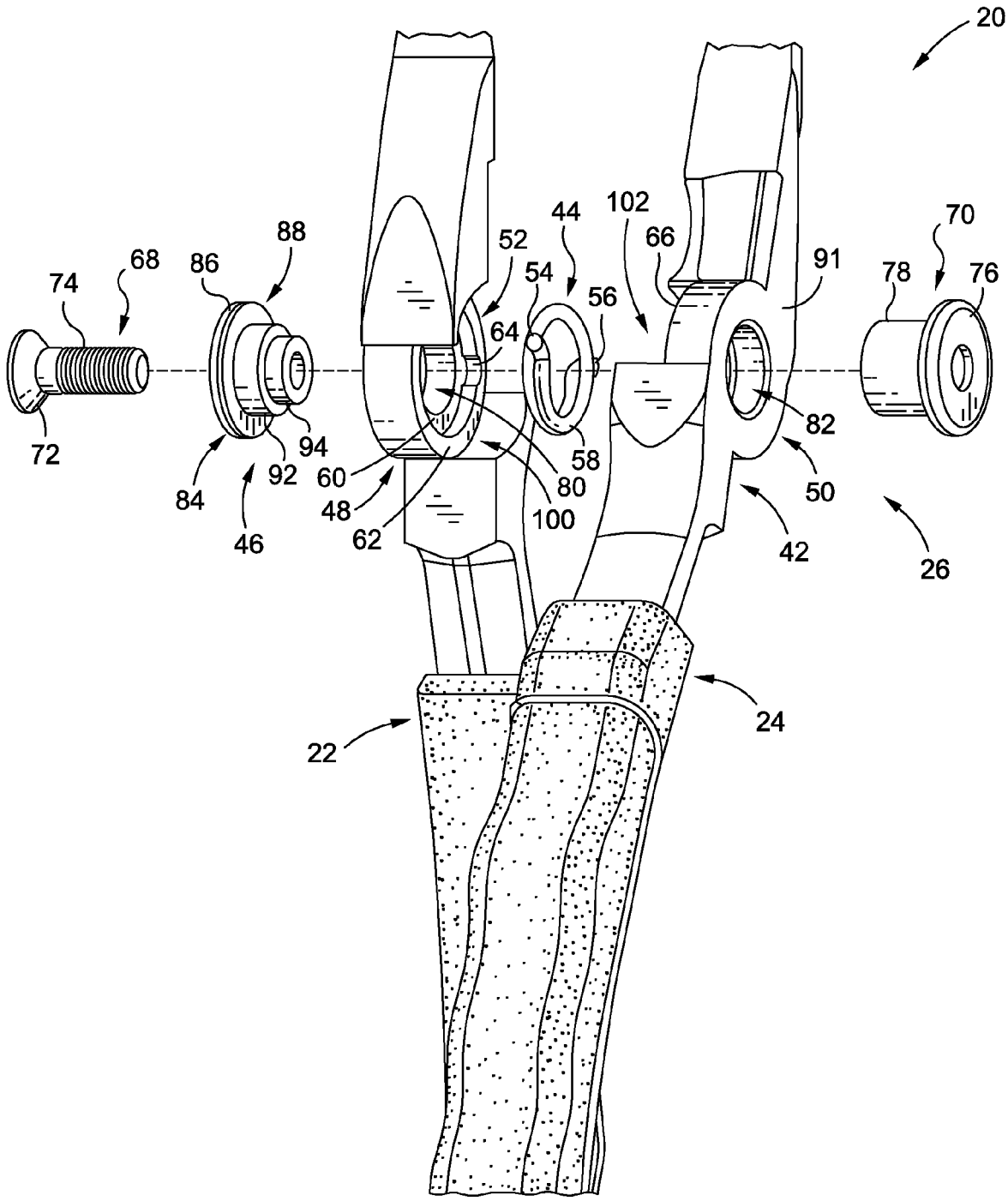
FIG. 2 is an enlarged perspective view of a hinge portion of one plier lever.

In one embodiment, referring to FIG. 2, the sleeve 88 of the secondary bushing 84 has a first portion 92 and a second portion 94. The first portion 92 preferably has a size close to that of the passage 80 through the first housing portion 48. For example, the diameter of the first portion 92 of the sleeve 88 of the secondary bushing 84 may be close in diameter to the passage 80, whereby the first plier lever 22 rotates about an axis through the passage 80 (and does not wobble or tilt).

The second portion 94 of the sleeve 88 of the secondary bushing 84 may extend from the first portion 92 and it may have a reduced diameter or size, such as to permit it to fit within or otherwise engage the passage through the bushing which comprises the female fastener 70 (or to fit within an enlarge portion of such a passage at the end of the sleeve 78 thereof), whereby the secondary bushing 84 and the female fastener 70 engage or connect to one another.

Referring to FIG. 1 again, when the coupler 46 is coupled, the housing 42 defined by the first and second housing portions 48,50 is closed. The torsion spring 44 is located in the interior area of that housing 42, completely closed therein.

The engagement of the ends 54,56 of the torsion spring 44 with the notches or mounts 64,65 in each housing portion 48,50, causes the first and second plier levers 22,24 to be biased into their open position as illustrated in FIG. 1.

In a preferred embodiment, the first and second housing portions 48,50 each have a depth of approximately one-half of the depth or thickness of their respective first and second plier levers 22,24. In one embodiment, the first and second plier lever 22,24 each have a generally planar inner face (facing the other plier lever) and a generally planar outer face (which serve as the outside surfaces or faces of the pliers 20).

Preferably, the first housing portion 48 is located at the outside of the first plier lever 28, whereby a recess 100 is located adjacent to the first housing portion 48. Likewise, the second housing portion 48 is located at the outside of the second plier lever 24, whereby a recess 102 is located adjacent to the second housing portion 50. When the first and second plier levers 22,24 are connected, the depth or thickness of the housing 42 is preferably the same as the depth or thickness of each plier lever 22,24. In particular, the first housing portion 48 associated with the first plier lever 22 fits within the recess 102 defined by the second plier lever 24, and the second housing portion 50 associated with the second plier lever 24 fits within the recess 100 defined by the first plier lever 22.

In a preferred embodiment, at least the outside or exterior of the sleeve 78 of the female fastener and of the sleeve 88 of the secondary bushing 84 is smooth. This promotes smooth rotation of the plier levers 22,24 relative to the coupler 46. In fact, in some embodiments the outside of the female fastener 70 and the secondary bushing 84 may be constructed of or comprise a low friction material or be lubricated.

The pliers 20 of the invention have numerous advantages. One advantage is that the ends 54,56 of the torsion spring 44 extend outwardly in generally the same plane as the body 58 of the spring. In this manner, the spring 44 has a low or thin profile, thus allowing it to fit within a housing 42 which has a thinner or lower profile than would be required for other spring configurations. This allows the pliers 20 to have an overall thin profile, which is important when the pliers 20 are to be used in small spaces.

Also, the torsion spring 44 is located between seats of the two housing portions 48,50 and is thus secured thereby, rather than being located in an open space and requiring other securing mechanisms. In this regard, the spring 44 is essentially self-locating, which improves the ease of manufacture of the pliers 20.

A particular advantage of the pliers 20 is that the plier levers 22,24 rotate about bushings 70,84, rather than a threaded connector. In particular, the mounting of the plier levers 22,24 about the bushings 70,84 causes the plier levers 22,24 to rotate smoothly (without binding) and about the axes there through (i.e. without wobbling or tilting, which could cause binding or cause the jaws of the plier levers 22,24 to move out of alignment). Also, this mounting serves to further fix the torsion spring 44 because the coupler 46 passes tightly through the torsion spring 44, preventing it from moving.

Another benefit of the invention is that the housing 42 and coupler 46 are compact and flush with the faces of the pliers 22,24, causing the pliers to be generally planar on each side and thin in profile.

It will be appreciated that the pliers 20 of the invention may have other configurations. In a preferred embodiment, the pliers 20 comprise fixed-joint pliers, though they could have other configurations. As indicated, the shape of the plier levers 22,24 may vary, including so that the configuration of the jaws vary, such as for different purposes.

It is possible for the coupler 46 to have other configurations. First, the configuration of the coupler 46 may be reversed. In such a configuration, the female fastener 70 may mount to the first plier lever 22 rather than the second plier lever 24.

In addition, the coupler 46 might comprise a single female bushing having a sleeve which extends entirely through the housing 42, and having a male fastener with an enlarged head with a shank that engages the female fastener (thus eliminating the secondary bushing while still causing both the first and second plier levers 22,24 to rotate about the sleeve of at least one bushing). In another configuration, the secondary bushing 84 and male fastener 68 might be integrated (such as by comprising a bushing having a head with a tool recess, having a main body or shank in the form of a sleeve and a second end comprising a threaded extension). Also, while the male and female fasteners may engage in a threading configuration, they might engage in other manners, such as by pressing the shank of the male fastener into the female fastener (press-fit) or through the female fastener wherein a tail may be connected to or formed at the end of the shank to lock the male and female fasteners together.

In yet another embodiment, the coupler 46 might comprise a central bushing which extends through the first and second plier levers 22,24 and first and second ends or caps. Each cap may have a generally planar head and a have a shank which extends into or otherwise engages an end of the central bushing, whereby the caps "close" each end of the central bushing at either side of the pliers.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A tool comprising:

a first tool lever having a first gripping end and a second jaw end;

a second tool lever having a first gripping end and a second jaw end;

said first and second tool levers pivotally connected whereby said tool has a first tool jaw end comprising said second jaw ends of said first and second tool levers and a generally opposing user-gripping end comprising said first gripping ends of said first and second tool levers;

said first and second tool levers collectively defining a housing between said first and second ends of said tool, said housing comprising a first housing portion defined by said first tool lever and a second housing portion defined by said second tool lever, said housing defining an interior area and having a passage there through;

a biasing member located in said interior area of said housing, said biasing member having a body having a first end and a second end, said first end engaging said first housing portion and said second end engaging said second housing portion; and a coupler joining said first and second tool levers, said coupler comprising a male fastener, a female fastener and a secondary bushing, said secondary bushing extending into said passage through said housing from an exterior of said first tool lever, said female fastener comprising a bushing extending into said passage through said housing from an exterior of said second tool lever, and said male fastener extending through said secondary bushing into engagement with said female fastener;

whereby said first and second tool levers are joined by said connected male and female fasteners, are biased to an open jaw position by said biasing member and may be pivoted about said secondary bushing and said bushing comprising said female fastener to a closed jaw position.

2. The tool in accordance with claim 1 wherein said tool comprises fixed-joint pliers.

3. The tool in accordance with claim 1 wherein said female fastener comprises a head having a sleeve with a generally smooth exterior surface extending there from.

4. The tool in accordance with claim 3 wherein said secondary bushing comprises a head having a sleeve extending there from.

5. The tool in accordance with claim 1 wherein a passage extends through at least a portion of said sleeve of said female fastener, at least a portion of said passage being threaded for engaging threads of said male fastener.

6. The tool in accordance with claim 4 wherein said head of said female fastener and said head of said secondary bushing are generally planar.

7. The tool in accordance with claim 1 wherein said female fastener and said secondary bushing engage one another.

8. The tool in accordance with claim 1 wherein said biasing member comprises a torsion spring.

9. The tool in accordance with claim 1 wherein said body is positioned in a first plane and said first and second ends of said biasing member project outwardly in generally opposing directions from one another and wherein said first and second ends are located in said first plane with said body.

10. The tool in accordance with claim 1 wherein said housing defines a first notch and a second notch generally 180 degrees from one another around said housing, said first end of said biasing member engages said first notch and said second end of said biasing member engages said second notch.

* * * * *